US008152141B2

(12) United States Patent
Langenwalter

(10) Patent No.: US 8,152,141 B2
(45) Date of Patent: Apr. 10, 2012

(54) DECORATIVE FENCING SYSTEM

(75) Inventor: Duane Langenwalter, Monroe, CT (US)

(73) Assignee: Origin Point Brands, LLC, Charleston, SC (US)

( * ) Notice: Subject to any disclaimer, the term of this patent is extended or adjusted under 35 U.S.C. 154(b) by 305 days.

(21) Appl. No.: 12/656,303

(22) Filed: Jan. 25, 2010

(65) Prior Publication Data

US 2010/0127231 A1 May 27, 2010

Related U.S. Application Data

(63) Continuation-in-part of application No. 10/797,410, filed on Mar. 10, 2004, now Pat. No. 7,677,534.

(51) Int. Cl.
*E04H 17/16* (2006.01)

(52) U.S. Cl. ..... 256/26; 256/21; 256/25

(58) Field of Classification Search ..... 256/21, 256/22, 24, 25, 26, 65.14, 73; 47/33
See application file for complete search history.

(56) References Cited

U.S. PATENT DOCUMENTS

| | | | | |
|---|---|---|---|---|
| 807 | A | | 9/1859 | Jenkins |
| 6,411 | A | | 2/1873 | Healey |
| 9,274 | A | | 5/1876 | Ricker |
| 207,518 | A | | 8/1878 | Hayden |
| 284,687 | A | | 9/1883 | Tunica |
| 336,405 | A | | 2/1886 | Ginther |
| 415,382 | A | | 11/1889 | Damell |
| 563,042 | A | | 6/1896 | Le Flamboy |
| 803,741 | A | | 11/1905 | Carlson |
| 1,331,117 | A | | 2/1920 | Miller |
| 1,426,215 | A | | 8/1922 | Ravert |
| 2,074,688 | A | | 3/1937 | Friend |
| 2,484,413 | A | | 3/1948 | Kouril, Jr. |
| 2,581,318 | A | | 1/1952 | Bartlett |
| 2,622,848 | A | | 12/1952 | Campbell |
| 2,651,502 | A | | 9/1953 | Carvelo et al. |
| 2,709,073 | A | | 2/1954 | Dougherty |
| 3,484,081 | A | | 12/1969 | Rowan |
| 3,924,913 | A | * | 12/1975 | Cooper ..... 256/25 |
| 4,324,388 | A | * | 4/1982 | Klaser ..... 256/19 |
| 5,301,926 | A | | 4/1994 | Sharp |
| 6,811,145 | B2 | | 11/2004 | Gibbs et al. |
| 2003/0155565 | A1 | | 8/2003 | Cantley |

* cited by examiner

*Primary Examiner* — Michael P Ferguson
(74) *Attorney, Agent, or Firm* — Turner Padget Graham & Laney, PA

(57) ABSTRACT

A customizable decorative fencing system. A plurality of stakes, configured to be driven into the ground at selected positions, have projecting portions projecting above the ground. Posts have cavities in lower distal ends thereof. Any stake projecting portion is configured to slide into any post cavity, and be frictionally, removably, interchangeably retained therein. Fence components, including base units, gate units, and end units, include post collars, and hinge collars, respectively, through which any post can slide. Removability and interchangeability of posts with respect to fence components, and removability and interchangeability of posts with respect to stakes, provides for an infinite number of possible fence configurations.

8 Claims, 4 Drawing Sheets

DECORATIVE FENCING SYSTEM

This application is a continuation-in-part of Ser. No. 10/797,410, filed on Mar. 10, 2004, now U.S. Pat. No. 7,677,534, the contents of which are incorporated herein by reference.

BACKGROUND OF THE INVENTION

1. Field of the Invention

The present invention relates generally to a customizable decorative fencing system, and, more particularly, to such a decorative fencing system that includes multiple components and may be arranged in a potentially infinite number of combinations and permutations so as to be used as a small or low fence, or a decorative accent for a yard or walk, or even a combination thereof.

2. Description of the Prior Art

Decorative fencing systems are known in the industry, as is the use of sectional fence structures to create configurations for fencing systems. None of the related fences address the problem recognized by the applicant, or offer the solution proposed by the applicant.

SUMMARY OF THE INVENTION

The present invention provides a customizable decorative fencing system having several components that may be arranged in a limitless number of configurations or combinations.

The present invention provides a decorative fencing system that may be used as a small or low fence, or a decorative accent for a yard or walk, or even a combination thereof.

The present invention also provides such a decorative system that allows a user to purchase and use only those elements necessary to create the design or shape of his or her choosing.

The present invention also provides a decorative fencing system that is easy to assemble and disassemble.

The present invention provides a decorative fencing system that may be either permanently or temporarily affixed to the ground The present invention also provides a decorative fencing system which includes all the elements necessary to create a standard fence, including base units, gates and end units.

The present invention also provides a decorative fencing system which may include a variety of interchangeable decorative elements.

The present invention also provides a decorative fencing system wherein individual components are manufactured from a variety of materials or be provided with a variety of finishes.

The present invention comprises a decorative fencing system designed to be used as a small fence or decorative accent for a yard, or combination thereof. The fencing system includes several different components that may be joined in various combinations so as to create a limitless number of different configurations or arrangements. The components include base units, decorative end units and gate units, each of which may be attached to the other components in any combination thereof. Each of these components are attached to post sections which are inserted through post rings or post hinges, respectively, on the individual components to thereby allow for each component to be rotated to the desired position relative to the post section. The post sections are secured to the ground by means of stakes, which are first driven into the ground. The stakes include upwardly projecting portions which slidably, removably, interchangeably insert into receiving portions in lower distal ends of the posts, to be removably, interchangeably, frictionally held therein. The posts can be removed from the stakes with or without changing the positions of the stakes in the ground, and then attached to other stakes, creating an infinite number of possible fence patterns.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

DETAILED DESCRIPTION OF THE INVENTION

Figure 1:
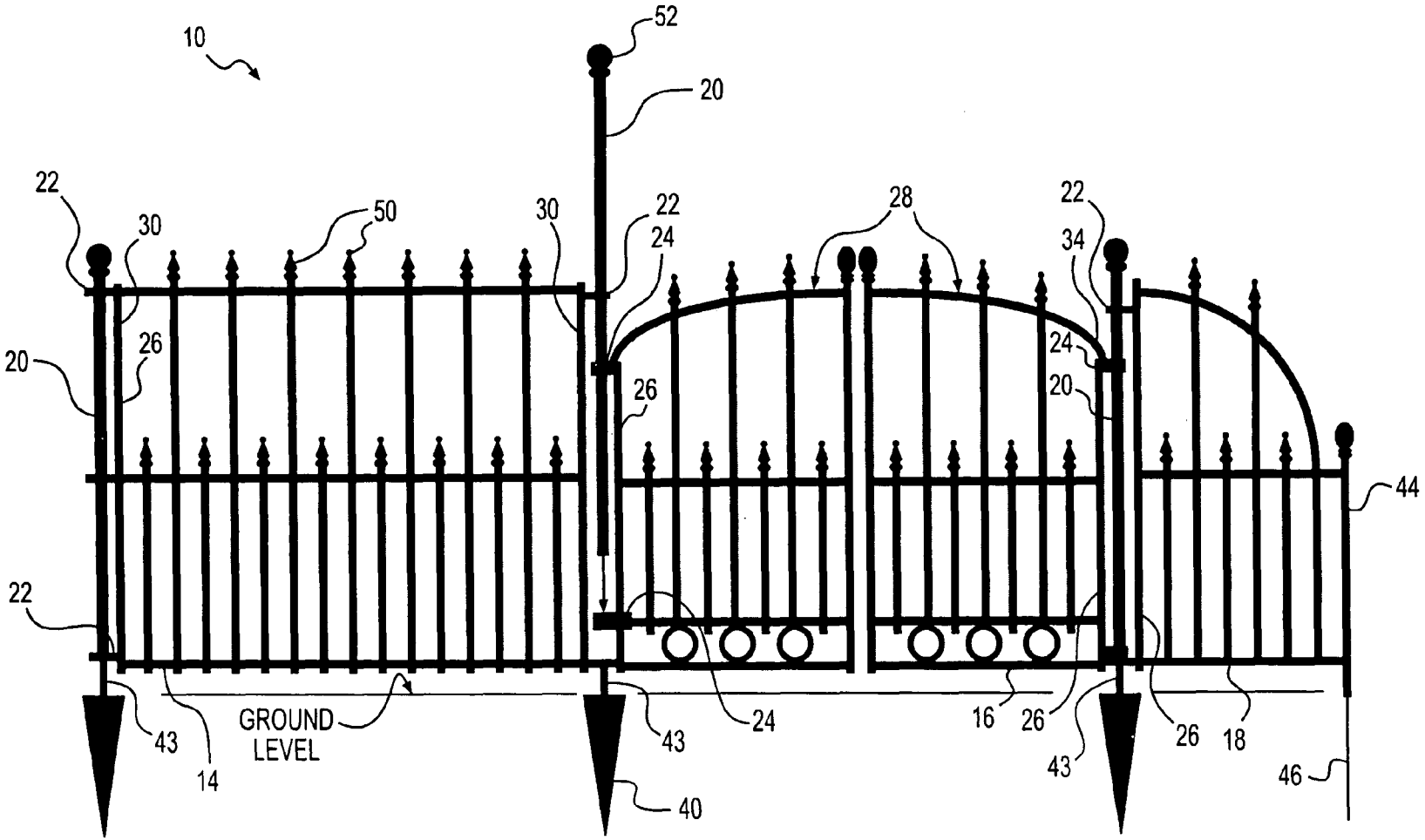
FIG. 1 is a frontal elevational view of the decorative fencing system of the present invention showing the various components thereof.
Figure 4:
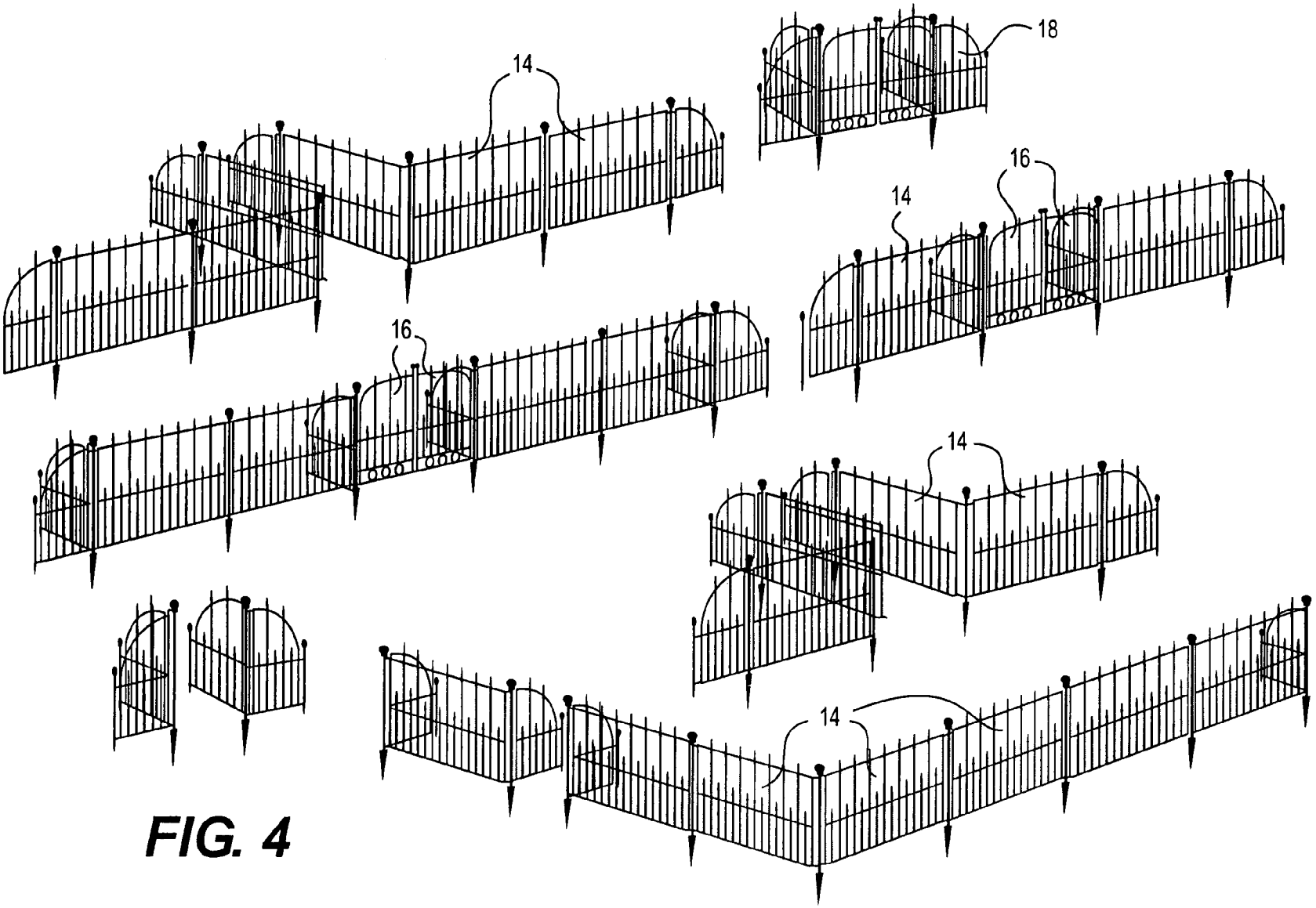
FIG. 4 depicts perspective views of various configurations of the decorative fencing system of the present invention.

Referring to the drawings and, in particular, to FIGS. 1 and 4, the decorative fencing system of the present invention, referred to generally by reference numeral 10, is illustrated. The fencing system 10 comprises separate structural components including base units 14, gate units 16 and end units 18, which are arranged and combined with each other so as to create a potentially limitless number of fence configurations.

Figure 3:
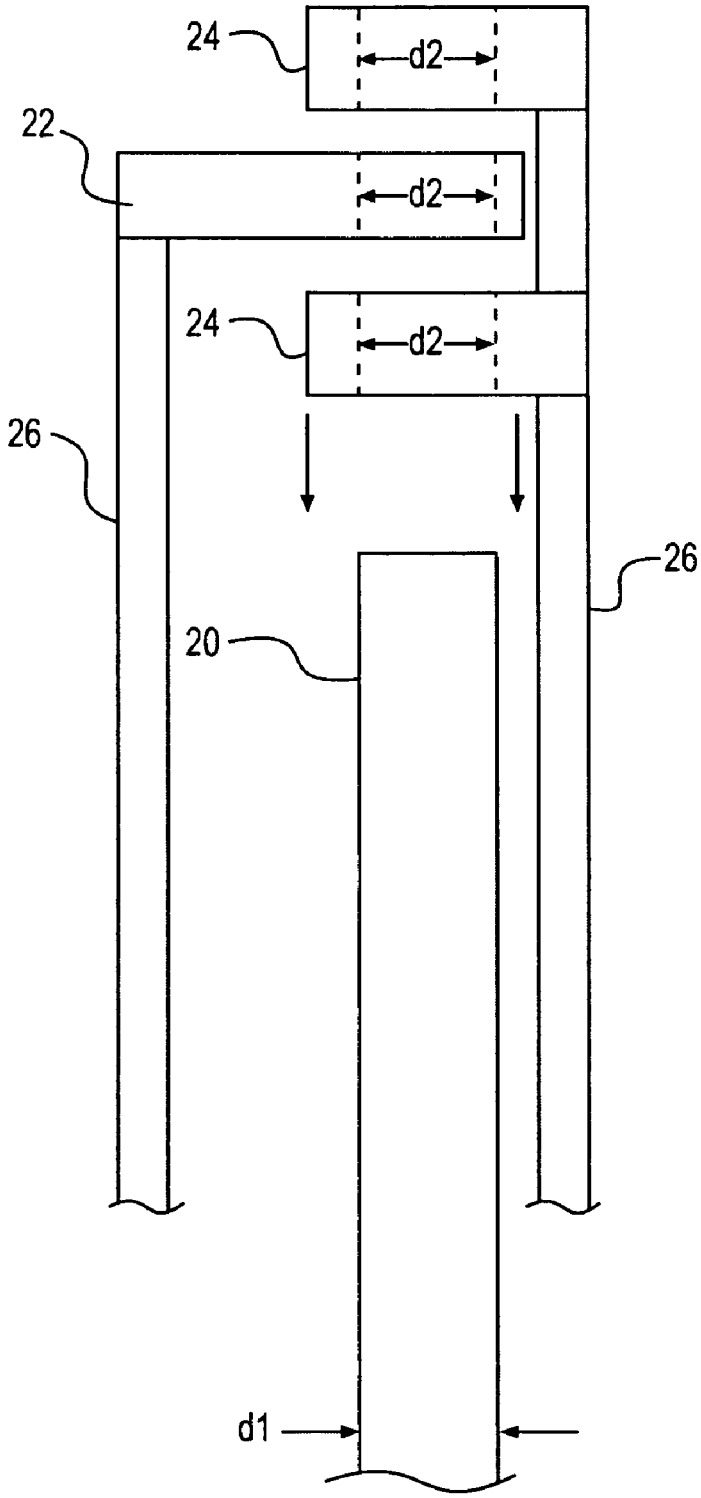
FIG. 3 is an exploded front elevational view depicting connection of aligned post rings or post hinges to a post in accordance with the invention.

The structural components are attached to each other by means of one or more posts 20 to which the structural components may be removably attached. Each post 20 is generally cylindrical and has an outer diameter d1. In the preferred embodiment, the means for attaching the structural components to the posts 20 comprise vertical elements 26 on the outer edges of the base units 14, gate units 16, and end units 18, and post rings 22, which are disposed on the vertical elements 26 of the base units 14, end units 18, or by post hinges 24, which are disposed on the vertical elements 26 of the gate units 16. As broadly embodied in FIG. 3, the post rings 22 and the post hinges 24 are essentially annular elements having an inner diameter d2 slightly larger than the diameter d1 of the posts 20, such that the posts 20 may be slidably inserted through the post rings 22 and the post hinges 24 to thereby engage either the base units 14, end units 18, and gate units 16. The post hinges 24 are coupled with individual gate elements 28 of the gate unit 16, to allow the gate unit 16 to swing open and shut. In the preferred embodiment the gate elements 28 comprise a pair of complimentary doors that may be operated independently or concurrently, although other designs are possible so as to fit with the design and theme of the decorative fencing system 10.

As illustrated in FIG. 1, each of the structural components includes two post rings 22 or post hinges 24 at each end at which the component may be attached to the post 20. For example, the base unit 14 includes two post rings 22 on either side thereof; the gate unit 16 includes two post hinges 24 on the outside edge of each gate element 28; and the end unit 18 includes two post rings 22 on one side thereof. The post rings 22 and post hinges 24 are attached to the vertical elements 20 so that the post rings 22 or post hinges 24 are in alignment when receiving the posts 20 therethrough. Alternate embodiments are contemplated in which either the post rings 22 or post hinges 24 are attached to other elements, provided however, that the post rings 22 or post hinges 24 are in alignment for insertion of the posts. Furthermore, while in the preferred embodiment only two post rings 22 or post hinges 24 are disposed along each vertical element 26, more post rings or post hinges may be provided, so as to further strengthen and secure the attachment of the structural components 12 to the posts 20.

It should also be appreciated that while in the preferred embodiment, the post rings 22 and post hinges 24 are disposed proximate the top and the bottom of the vertical elements 26, as shown in FIG. 1, they may be positioned at various positions along the length of the vertical elements 26 as may be desired. For example, as illustrated in FIG. 1, the position of the upper post ring 22 on the base unit 14 is higher than that of the upper post ring 22 on the end unit 18, which, in turn, is higher than upper post hinge 24 on the gate unit 16. This configuration facilitates the combination of two or more structural components 12 since the post rings 22 and post hinges 24 will not necessarily interfere with each other. It also should be appreciated that in the preferred embodiment, contact should be avoided between the post hinges 24 and the post rings 22 so as to prevent interference with the operation of the post hinges 24: Toward that end, it may be preferred to mount the lower post hinges 24 of the gate unit 16 above the lower post rings 22 of either the base unit 14 or the end unit 18.

The decorative fencing system 10 is secured to the ground by means of one or more stakes 40. The stakes 40 are designed to be driven into the ground and receive and support the posts 20, to thereby support the structural components 12 in place. In the preferred embodiment, the stakes 40 are wedge shaped or include a plurality of fins so as to facilitate their insertion into the ground, although a variety of alternative designs are possible. For example, the shape of the stakes 40 is designed with the idea that the stakes will be forcibly driven by the user into the ground. However, if the user prefers to dig holes for the stakes 40, and bury them in the ground, these elements could be of practically any shape or size, provided they can receive and support the posts 20.

In the preferred embodiment, the stakes 40 receive and support the posts 20 by means of projecting portions 43, projecting above the ground after insertion of the stakes 40 into the ground. Each projecting portion 43 is generally cylindrical and has an external diameter d3. Meanwhile, a lower distal end 20*a* of each post 20 includes a cylindrical recess or cavity 20*b* defined within the body of the stake 20, having an internal diameter d4, which is slightly larger than the diameter d3 of each projecting portion 43, such that any projecting portion 43 can be slidably, interchangeably received within and removably retained by any recess 20*b* in any distal end 20*a* of any stake 20, by means of removable frictional contact therebetween.

Ideally, the recess 20*b* in lower distal end 20*a* should be of sufficient length so as to securely receive the projecting portion 43, and the length of the portion of the stake 40 that is inserted into the ground should be sufficient to prevent the post 20 from toppling over when the decorative fencing system 10 is assembled. In the preferred embodiment, the length of the portion of the stake 40 that is inserted into the ground is approximately 10 inches, although longer stakes 40 would function just as well, and shorter ones also may serve effectively provided the weight of the structural components and posts 20 are not to great, and provided the ground itself is firm enough to retain the stake 40 therein. Also in the preferred embodiment, the projecting portion 43 should extend above the ground level by a sufficient height to allow a desired clearance between the bottom of the structural components 12 and the ground. This is of particular importance for the gate unit 16, since the gate elements must clear any uneven ground so as to allow the elements to open and close properly. Furthermore, the combined weight of the posts 20 and any structural components 12 attached thereto serve to force the posts 20 down onto the projecting portions 43, preventing the posts 20 from sliding off of projecting portions 43.

The end units 18 serve to provide decorative termination points for the decorative fencing system 10, and as such, include a decorative termination point 44 on the side opposite the vertical element 30, i.e., the side to which the post rings 22 are attached. Rather than use a separate post 20 to anchor the termination point 44 to the ground, a separate stake pin 46 is provided at the termination point 44. The stake pin 46 extends below ground level when the end unit 18 is attached, thereby further securing the end of the end unit 18 to the ground. As illustrated in FIG. 1, in the preferred embodiment the stake pin 46 is long and thin to facilitate its insertion into the ground. It is also of approximately the same length as the stake 40, although a shorter stake pin 46 would work just as effectively.

Figure 2A:
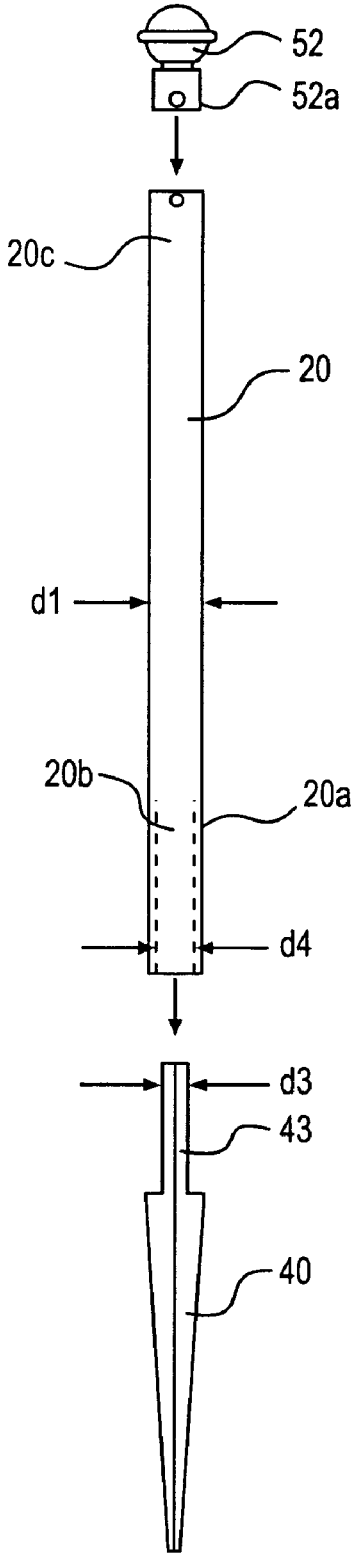
FIG. 2A is an exploded front elevational view of a disconnected post and stake of the decorative fencing system of the present invention.
Figure 2B:
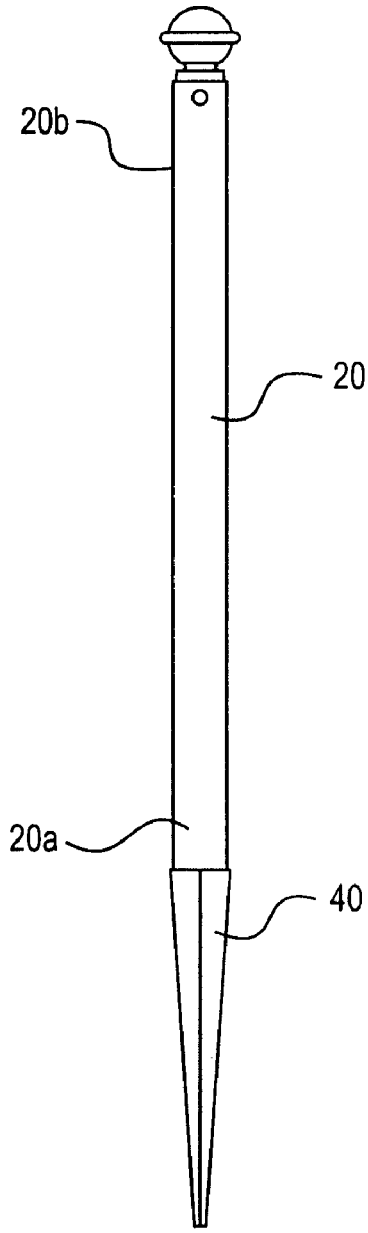
FIG. 2B is an exploded front elevational view of the post and stake of FIG. 2A after being connected together, of the decorative fencing system of the present invention.

As depicted in FIGS. 1 and 2A, decorative accents 52, for example ball caps, may be attached to upper distal ends 20*c* of each post 20.

In the preferred embodiment, the components of the decorative fencing system 10 are manufactured from tubular steel, both square and round stock. A powder coat finish may be provided on some or all of the elements. For example, a separate color or finish or a different material, such as bronze colored cast iron, may be used for decorative accents 52. All the steel components are ideally welded in assembly, and the decorative accents 52 may be held in place by force fit, adhesive, welding, some combination thereof or other means known in the art.

Alternative manufacturing variations also are contemplated, including manufacturing individual components out of solid iron or steel pieces, welding and finishing by powder coating or painting. The components may be produced as individual cast iron pieces and finished with various paint techniques to create different appearances.

It should be appreciated that the design of the individual structural components shown in the Figures is just one possible design for the decorative fencing system 10 of the present invention. A variety of different designs and decorative accents 48 are contemplated, such as a Victorian design or a more modern design.

The fencing system 10 is configured for easy assembly and easy customizable alteration. In the preferred embodiment, a plurality of stakes 40 are driven into the ground at desired positions, defining any desired pattern. Selected posts 20 are inserted through aligned post rings 22 and/or aligned post hinges 24, and then recesses 20*b* in lower distal ends 20*a* of the selected posts 20 are inserted onto selected projecting portions 43 of selected stakes 40. The selected posts 20 can be inserted onto any stakes 40 in the pattern, defining any desired pattern of a fence. The posts 20 may or may not be inserted onto all of the stakes 40, as the user prefers.

The above-described assembly step defines one desired fence configuration. The posts 20 may then be removed from the stakes 40, and reinserted through either the same or different aligned post rings 22 and/or post hinges 24 onto different selected projecting portions 43 of different selected stakes 40, to define a slightly different fence configuration completely different fence configuration, as desired. Between the post attachment steps, the stakes 40 either can be left in the ground in their originally-inserted positions, or else the stakes 40 can be removed and moved to different positions in the ground, as desired. The process can be repeated as necessary until the desired fence configuration is achieved, allowing for a potentially infinite number of combinations and angles between the structural components. Some examples of these variations are illustrated in FIG. 4, but FIG. 4 does not limit the potential patterns or fence configurations available to the user of the invention. Moreover, since each of the structural components 12, posts 20, and stakes 40 may be purchased separately, the decorative fencing system 10 may be as large or as small as the user desires.

Having thus described the-invention with particular reference to the preferred forms thereof, it will be obvious that various changes and modifications can be made therein without departing from the spirit and scope of the present invention. For example, instead of generally cylindrical posts, generally cylindrical stake projecting portions, and annular post and hinge attachment portions, these components could have a generally rectangular configuration. Other modifications are within the skill of persons of ordinary skill in the art. The invention is limited and defined only by the appended claims and their legal equivalents.

What is claimed is:

1. A fencing system comprising:

a plurality of stakes configured to be driven into the ground, each said stake including a projecting member having an outer first diameter configured to project above the ground when the stake is driven into the ground;

a plurality of posts, each said post having an outer diameter and a recess in a lower distal end thereof, each recess having an internal second diameter greater than the first diameter, any one of said projecting members slidably, interchangeably inserting into and being frictionally and removably retained by said recess of any one of said posts; and a plurality of structural fencing components, each said fencing component including a vertical element disposed at at least one side edge thereof and a pair of axially aligned post attachment collars, one of said post attachment collars being disposed at a first upper position on said vertical element and the other said post attachment collar disposed at a second lower position on said vertical element, said post attachment collars each having an annular opening therethrough with an internal third diameter larger than said outer diameter of each said post, said fencing components slidably, rotatably, removably and interchangeably attaching to said posts to thereby connect adjacent structural fencing components to each other while allowing said fencing components to be rotationally adjusted relative to said post;

wherein said stakes are configured to be inserted at a plurality of selected locations in the ground, and said adjacent fencing components are aligned such that said openings of said post attachment collars of said adjacent fencing components are axially aligned and a selected one of said posts is downwardly inserted through said aligned post attachment collars onto said projecting member of a selected one of said stakes;

said structural fencing components being chosen from the group consisting of interchangeable base units, interchangeable gate units and interchangeable end units.

2. The fencing system of claim 1, wherein said base units each include a vertical element on each side thereof, and wherein said post attachment collars comprise post rings.

3. The fencing system of claim 1, wherein said gate units each comprise a pair of complementary doors each having an outside edge, wherein said outside edges terminate in a vertical element and wherein said post attachment collars comprise a pair of post hinges disposed at first and second upper and lower positions of said vertical elements, said post hinges including a post ring and a hinge element to allow said complementary doors to open and close.

4. The fencing system of claim 1, wherein said end units each include a vertical element on one side thereof, and wherein said post attachment collars comprise post rings disposed at first and second upper and lower positions of said vertical element, and wherein said end unit further includes a stake pin disposed on the side opposite said vertical element, said stake pin being adapted to be inserted into the ground to anchor said end unit in position.

5. The fencing system of claim 1, wherein said adjacent fencing components are aligned such that said openings of said attachment collars of said adjacent fencing components are axially aligned above a selected one of said stakes.

6. The fencing system of claim 1, wherein the first and second positions are disposed at the respective top and bottom of said vertical elements.

7. A fencing system comprising:

a plurality of wedge-shaped stakes configured to be driven into the ground, each said stake including a projecting portion projecting above the ground, having an outer first diameter;

a plurality of posts, each said post having an outer diameter and a recess in a lower distal end thereof, each recess having an internal second diameter larger than the first diameter, any one of said posts slidably inserting onto and being frictionally, interchangeably, and removably retained by said projecting portion of any one of said stakes; and a plurality of structural fencing components, each said fencing component including a vertical element disposed at at least one side edge thereof and a pair of axially aligned post attachment collars, one of said post attachment collars disposed at an upper portion of said vertical element and the other said post attachment collar disposed at a lower portion of said vertical element, said post attachment collars each having an annular opening therethrough with an internal third diameter larger than said outer diameter of each said post, said fencing components slidably, rotatably, removably and interchangeably attaching to said posts to thereby connect adjacent structural fencing components to each other while allowing said fencing components to be rotationally adjusted relative to said post;

wherein said stakes are configured to be inserted at a plurality of selected locations in the ground, and said adjacent fencing components are aligned such that said openings of said post attachment collars of said adjacent fencing components are axially aligned and a selected one of said posts is downwardly inserted through said aligned post attachment collars onto said projecting portion of a selected one of said stakes;

said structural fencing components being chosen from the group consisting of interchangeable base units, interchangeable gate units and interchangeable end units, wherein:

said base units each include a vertical element on each side thereof, and wherein said post attachment collars comprise post rings;

said gate units each comprise a pair of complementary doors each having an outside edge, wherein said outside edges terminate in a vertical element and wherein said post attachment collars comprise a pair of post hinges disposed at the top and bottom of said vertical elements, said post hinges including a post ring and a hinge element to allow said complementary doors to open and close; and said end units each include a vertical element on one side thereof, wherein said post attachment collars comprise post rings disposed at the top and bottom of said vertical element, and wherein said end unit further includes a stake pin disposed on the side opposite said vertical element, said stake pin being adapted to be inserted into the ground to anchor said end unit in position.

8. A fencing system of claim 7, wherein said adjacent fencing components are aligned such that said openings of said post attachment collars of said adjacent fencing components are axially aligned above a selected one of said stakes.

* * * * *